United States Patent [19]

Forney, Jr.

[11] 4,452,503

[45] Jun. 5, 1984

[54] CONNECTOR FOR SEMIRIGID COAXIAL CABLE

[75] Inventor: Edgar W. Forney, Jr., Harrisburg, Pa.

[73] Assignee: AMP Incorporated, Harrisburg, Pa.

[21] Appl. No.: 502,349

[22] Filed: Jun. 10, 1983

Related U.S. Application Data

[63] Continuation of Ser. No. 222,188, Jan. 2, 1981, abandoned.

[51] Int. Cl.[3] ..... H01R 17/00

[52] U.S. Cl. ..... 339/177 R; 339/89 C

[58] Field of Search ..... 339/89, 90, 177

[56] References Cited

U.S. PATENT DOCUMENTS

| | | | |
|---|---|---|---|
| 2,294,432 | 9/1942 | Weidner | 339/89 C |
| 2,296,766 | 9/1942 | Bruno | 339/89 C |
| 3,448,430 | 6/1969 | Kelly | 339/143 |
| 3,537,065 | 10/1970 | Winston | 339/177 |
| 3,544,705 | 12/1970 | Winston | 174/75 |
| 3,744,007 | 7/1973 | Horak | 339/97 R |
| 3,836,700 | 9/1974 | Miemeyer | 339/89 R |
| 3,879,102 | 4/1975 | Horak | 339/143 R |
| 4,131,332 | 12/1978 | Hogendobler et al. | 339/177 R |

FOREIGN PATENT DOCUMENTS

| | | | |
|---|---|---|---|
| 923144 | 2/1955 | Fed. Rep. of Germany | 339/97 R |
| 1117687 | 11/1961 | Fed. Rep. of Germany . | |
| 2234680 | 7/1972 | France . | |

*Primary Examiner*—Joseph H. McGlynn

*Attorney, Agent, or Firm*—Adrian J. LaRue; Richard B. O'Planick

[57] ABSTRACT

An electrical connector is disclosed for terminating semi-rigid coaxial cable, and comprises a grip ring having a solid rearward end and multiple spline fingers extending forwardly therefrom, and a bored tubular shell member having a contoured internal diameter to accept the cable and the grip ring. The cable is drawn through the grip ring and the shell member, and as the grip ring is press inserted into a rearward end of the shell member, the spline fingers resiliently deflect inwardly along the shell member contour, and embed into the outer semi-rigid cable sheath to establish electrical contact therewith.

19 Claims, 6 Drawing Figures

CONNECTOR FOR SEMIRIGID COAXIAL CABLE

This is a continuation of application Ser. No. 222,188, filed Jan. 2, 1981 now abandoned.

BACKGROUND OF THE INVENTION

1. Field of the Invention

This invention relates to connector terminations for semi-rigid coaxial cable.

2. The Prior Art

The electrical industry utilizes semi-rigid coaxial cable in high performance RF applications. Use of such cables, however, has been limited because of the difficulty in achieving cable end termination. The solid, semi-rigid sheath of the coaxial cable, usually made of copper, makes it difficult to establish connectorized contact therewith without degrading electrical performance at the junction. While there are effective connectors available within the industry for this purpose, such connectors are generally expensive to produce, of multi-piece design, and employ costly, labor intensive procedures to achieve cable end termination. One state-of-the-art procedure consists of pre-knurling the coaxial cable sheath, and subsequently crimping a copper connector sleeve thereto. While this approach achieves effective results, pre-knurling requires time, and inherently involves considerable variability due to sheath hardness variation, cable diameter variation, and metal build up on the knurling tool. Another procedure for making connectorized contact with the outer cable sheath is by way of solder; however, soldering also entails shortcomings due to the excessive time required to effect a termination, and the inherent necessity of controlling the narrow temperature range required to effect a good joint to sem-rigid cable. Too low a temperature will form a weak "cold" solder joint; too high a temperature will cause excessive expansion and protrusion of the cable dielectric at the mating interfaces.

SUMMARY OF THE INVENTION

The present invention comprises a connector plug for terminating semi-rigid coaxial cable. The plug includes a grip ring having a solid rearward end, and having multiple spline fingers extending forwardly therefrom; a tubular shell member having a bore of contoured internal diameter to accept the cable and the grip ring; external coupling means secured to the shell member; and forward gasket means for sealing the forward plug interface. The cable is drawn through the grip ring and the shell member, and as the grip ring is press inserted into a rearward end of the bored shell member, the spline fingers resiliently deflect inwardly along the contour of the shell bore to embed into the outer semi-rigid sheath of the cable. Internal longitudinal grooves are integrally provided within the rearward portion of the shell member which embed into the solid area of the grip ring to resist relative rotational motion betwen the grip ring and the shell member.

Accordingly, it is an object of the present invention to provide a connector for achieving consistent mechanical and electrical termination of semi-rigid coaxial cable.

A further object of the present invention is to provide a connector for semi-rigid coaxial cable having integral sealing means.

A still further object of the present invention is to provide a connector for semi-rigid coaxial cable which is capable of field assembly.

A still further object of the present invention is to provide a connector for semi-rigid coaxial cable having integral retention means for controlling relative movement of connector parts.

Yet, a further object of the present invention is to provide a connector for semi-rigid coaxial cable which is readily and economically produced, and readily assembled.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
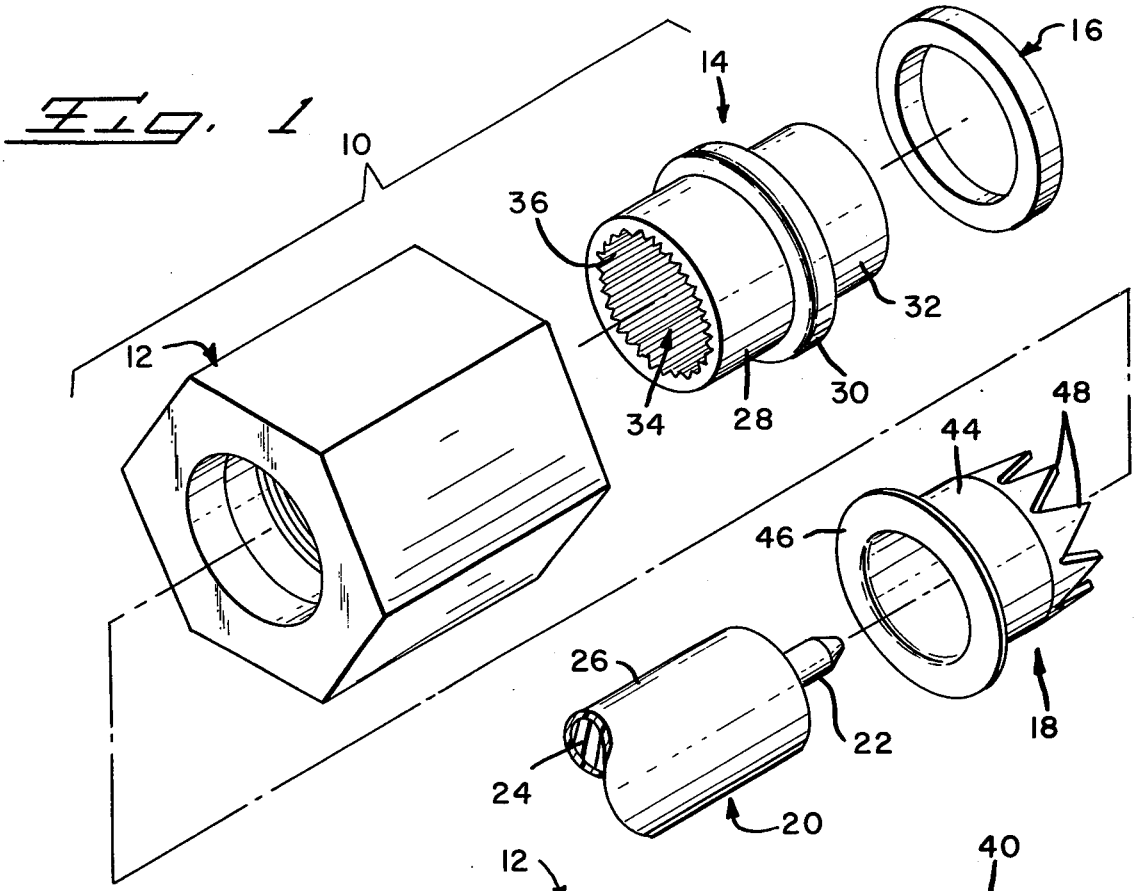
FIG. 1 is an exploded perspective view of the subject connector plug prior to assembly.
Figure 2:
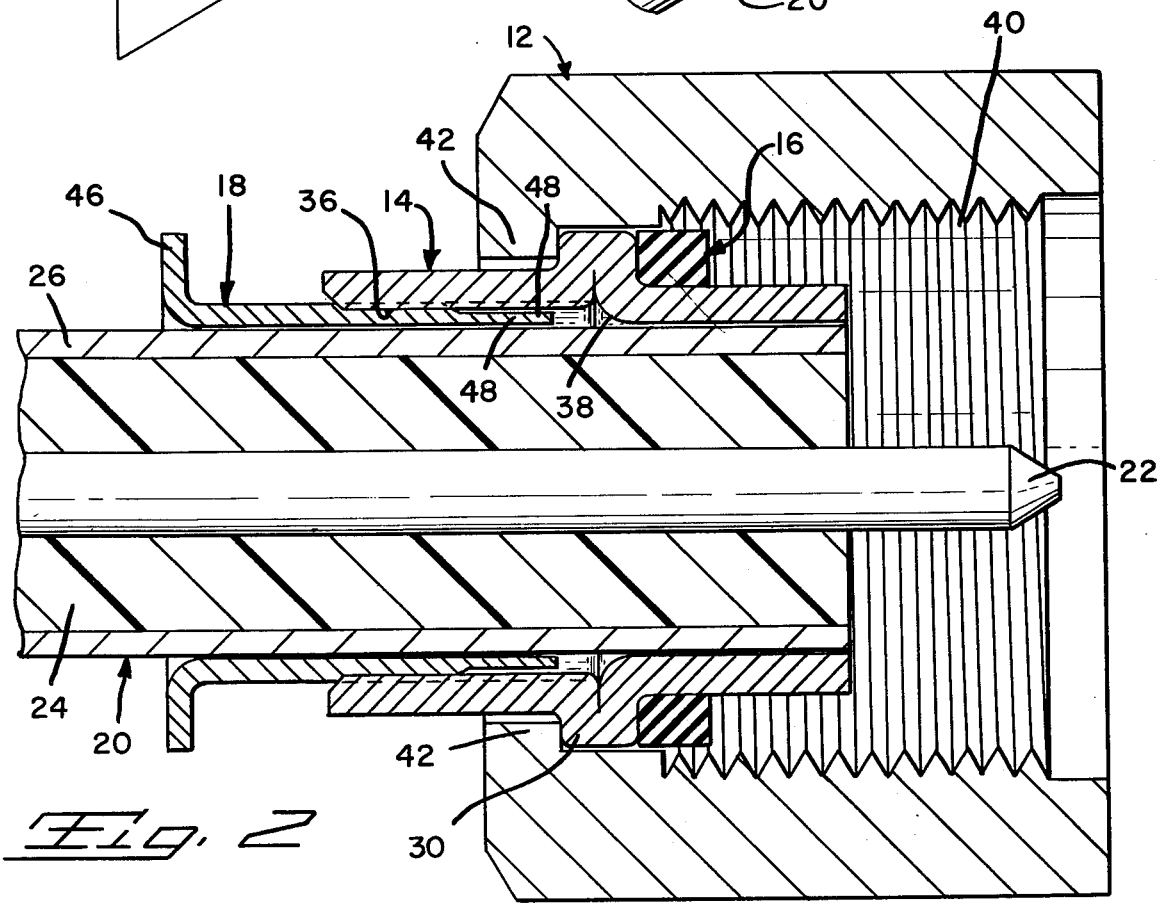
FIG. 2 is a side elevation view, taken partially in section, of the subject connector plug with the coaxial cable properly positioned prior to the insertion of the grip ring into the shell body.

Referring first to FIG. 1, the subject connector plug 10 for terminating semi-rigid coaxial cable is shown to comprise an elongate coupling nut 12, a tubular shell body 14, a gasket ring 16, and a grip ring 18. The subject connector plug is intended to terminate a semi-rigid coaxial cable 20, of the type comprising a center conductor 22, an intermediate dielectric layer 24, and an outer metallic solid sheath 26. The outer sheath 26 is commonly made of copper or like conductive metal. As shown, the center conductor 22 of the coaxial cable 20 is prepared to project forward a distance from the intermediate dielectric layer 24 and the metallic sheath 26 therearound. The tubular shell body 14, as illustrated in FIGS. 1 and 2, is adapted as having a rearward portion 28, an annular flange 30 intermediately provided therearound, and a forward portion 32. A bore 34 extends longitudinally through the shell body 14, and a plurality of grooves 36 are provided within the interior walls of the rearward portion 28 defining the bore 34. As best shown by FIG. 2, the interior of the shell body 14 is contoured forwardly from the rearward portion 28 towards the forward portion 32 as indicated by reference numeral 38. The purpose for this forward contour will be explained in greater detail below.

Continuing, the coupling nut 12 is internally threaded as indicated at 40, and further includes an inwardly projecting annular lip 42. The grip ring 18, as shown in FIG. 1, includes a solid body portion 44, multiple spline fingers 48 projecting forwardly from the periphery of the solid body portion 44, and an outwardly directed annular flange 46 at the rearward end of the solid body portion 44.

Figure 3A:
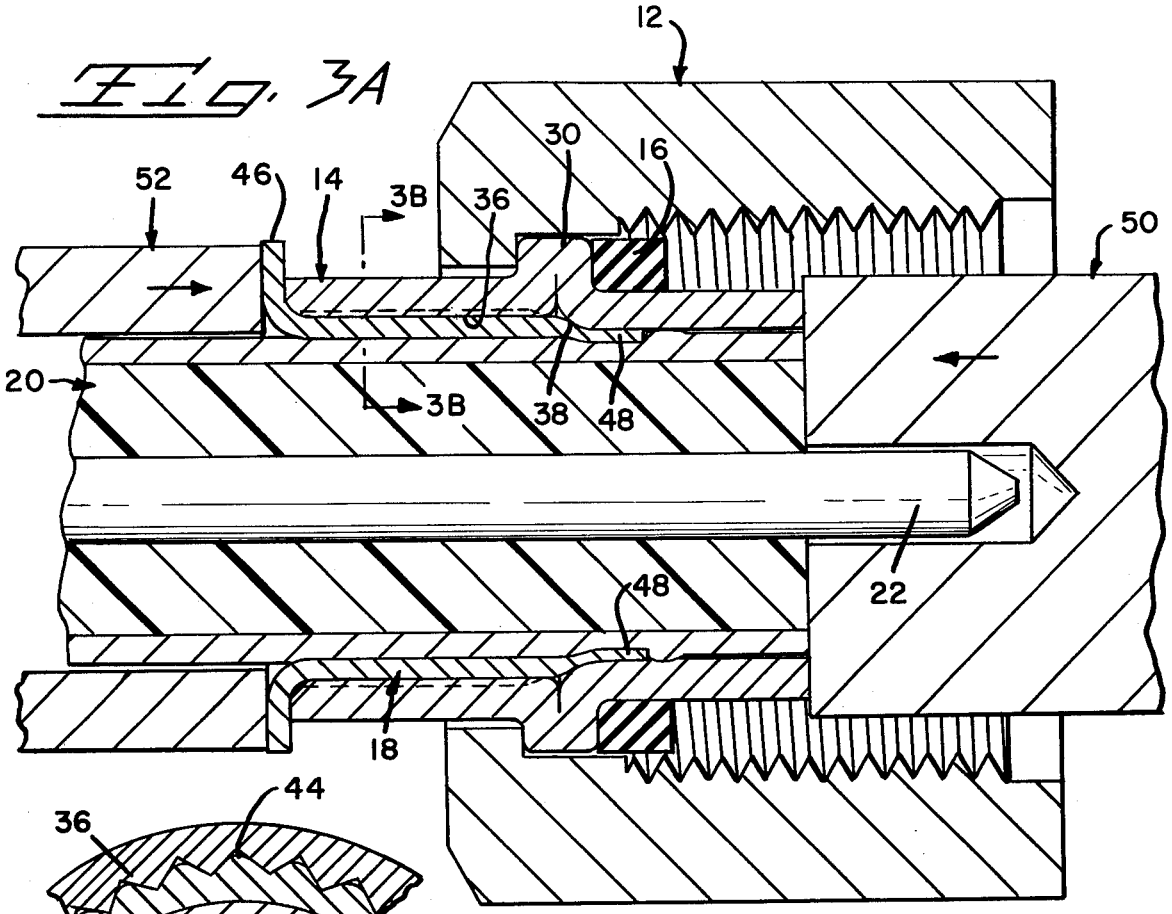
FIG. 3A is a side elevation view, taken partially in section, of the subject connector plug subsequent to full insertion of the grip ring into the shell body completing the termination to the coaxial cable.

Assembly of the subject connector procedes as follows. Referring to FIG. 2, the gasket ring 16 is first assembled over and against the annular flange 30 of the shell body 14. The coupling nut 12, is positioned having the annular lip 42 in engagement against the rearward side of the shell body annular flange 30, and projects forwardly therefrom. The grip ring 18 is slideably moved forward into the rearward end of the shell body 14, and there awaits the application of the termination tooling. As illustrated in FIG. 3A, the assembly tool has two opposing members 50, 52 which move relative to each other on a common axis. With the grip ring 18, coupling nut 12, and the shell body 14 preassembled over the cable as set forth above, the forward surface of the tool member 50 locates the end of the connector shell body 14 flush with the end of the cable sheath 26. The forwardmost extending surface of the other tool member 52 then presses the grip ring 18 into the shell body 14 until the flange 46 of the grip ring bottoms. The coupling nut 12 is trapped between the grip ring flange 46 and the shell body flange 30.

With continuing reference to FIG. 3A, some general comments on the action of the grip ring 18 follow. As the spline fingers 48 enter the shell body 14, they are deflected inward by contour 38 of the shell body 14. The spline fingers 48 are forced into the softer cable sheath 26, plowing progressively deeper furrows with the forward motion. The spline fingers are sharp pointed for easy penetration and minimum distortion of the cable sheath 26. The self-splining action provides torque resistence and the tapered penetration resists tensile forces exerted upon the cable 20.

Figure 3B:
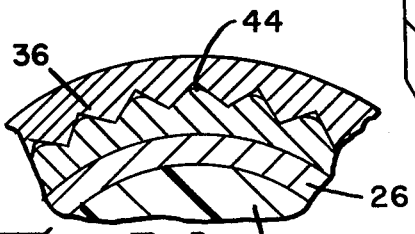
FIG. 3B is a view in transverse section of the connector plug illustrated in FIG. 3A, taken along the line 3B.

Referring to FIG. 3B, it will be appreciated that interaction between grip ring solid surface 44 and the longitudinal grooves 36 of the wall body 14 creates an interlocking relationship. This interlocking engagement further acts to resist any externally originating torque generated on the cable. Further, the interlocking press fit between the grooves 36 and surface 44 resists tensile forces between the grip ring 18 and the shell body 14 in the assembled state.

Figure 4:
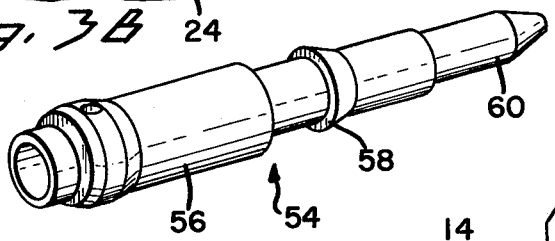
FIG. 4 is a perspective view of a contact member suitable for incorporation into an alternative embodiment of the subject invention.
Figure 5:
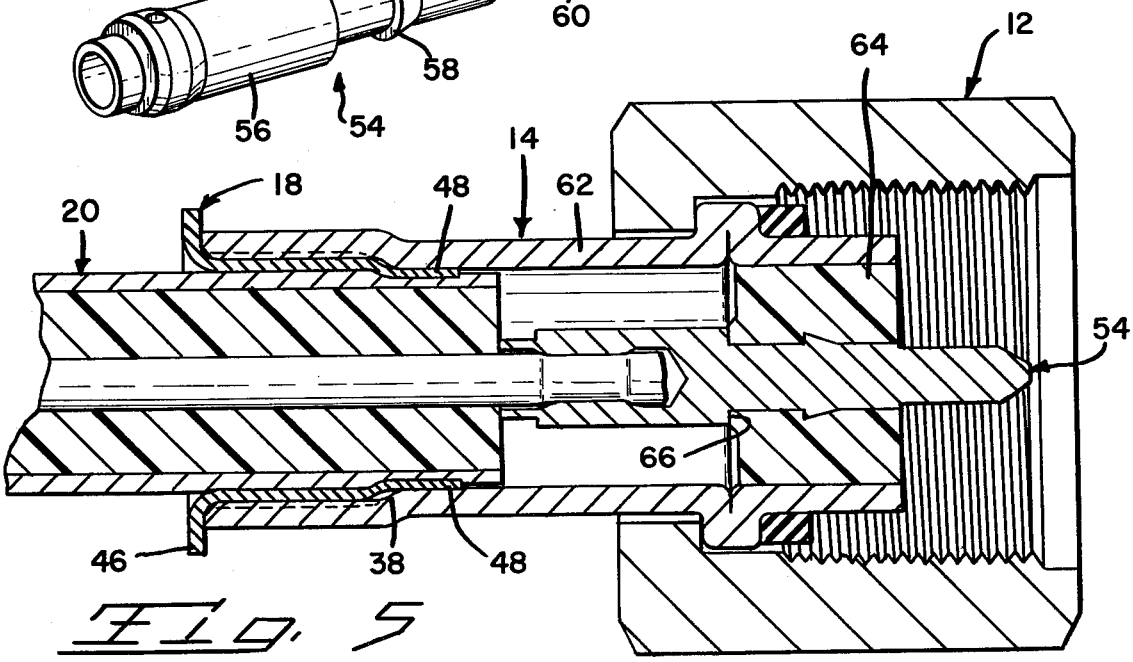
FIG. 5 is a side elevation view taken partially in section of a connector plug alternatively embodying the principles of the subject invention.

The subject invention is applicable to other connector configurations, such as cable jacks, and to other cable plug embodiments. One such other cable plug embodiment is illustrated in assembled transverse section by FIG. 5, and incorporates the use of a contact member 54 illustrated in FIG. 4. Referring to FIG. 4, the contact member 54 comprises a rearward crimp barrel 56, an intermediate annular latching projection 58, and a forward pin portion 60. As shown in FIG. 5, the contact member 54 is intended for engagement to the forwardly extending center conductor 22 of the semi-rigid cable 20, with the rearward crimp barrel 56 of the contact member 54 crimped to the center conductor 22 in a manner conventional to the industry. It will be further appreciated from FIG. 5 that the alternative embodiment of the subject invention includes a tubular shell body 14 having an elongated mid-portion 62. Further comprising the plug assembly shown in FIG. 5, is a dielectric insert body 64 intended for insertion into the forward end of the shell body 14, said insert 64 receiving the mid-portion of the contact member 54 therein. The annular latching projection 58 of the contact member 54 engages the dielectric insert 64 to retain the contact member therein, and a rearwardly extending shoulder 66 of the dielectric insert 64 abuts against the rearward crimp barrel portion 56 of the contact member. Assembly of the alternative plug embodiment in FIG. 5 procedes in the manner explained above for the preferred embodiment, with the grip ring 18 moved forward into the rearward portion of the shell body 14, and with the spline fingers 48 of the grip ring 18 deflected inwardly to embed into the outer metallic sheath 26 of the cable 20. It will be appreciated that the contact member 54 projects through the elongate mid-portion 62 of the shell body 14 and, therein, is surrounded by free space.

While the above description of the preferred embodiment and the alternative embodiment exemplify principles of the subject invention, other embodiments which will be apparent to one skilled in the art and which utilize the teachings herein set forth are intended to within the scope and spirit of the subject invention.

What is claimed is:

1. An electrical connector plug for terminating semi-rigid coaxial cable, comprising:

center contact means in electrical engagement with a center conductor of said cable;

a bored tubular shell member having rearward bore means of relatively large inner diameter inwardly contoured toward forward bore means having a relatively smaller inner diameter dimensioned to receive said cable and said contact means therethrough;

external coupling means engaging said tubular member;

bored gripping means having a rearward collar portion dimensioned to closely receive said cable therethrough, and having a plurality of spline fingers extending forward from the periphery of said collar portion defining therebetween a profiled opening of a dimension substantially equal to said cable diameter, and said gripping means being rearwardly disposed of said tubular member, whereby, upon moving said gripping means forwardly into said rearward bore means, said spline fingers are resiliently deflected inwardly along said contour to embed into an outer conductive layer of said cable, said tubular shell member having longitudinal grooves within rearward walls defining said rearward bore means, said grooves engaging said gripping means collar portion for resisting rotational motion of said gripping means within said tubular shell member.

2. A connector plug as set forth in claim 1, said spline fingers each being tapered to a point.

3. An electrical connector plug for terminating semi-rigid coaxial cable, comprising:

center contact means in electrical engagement with a center conductor of said cable;

a bored tubular shell member having rearward bore means of relative large inner diameter inwardly contoured toward forward bore means having a relatively smaller inner diameter dimensioned to receive said cable and said contact means therethrough, and said shell member having longitudinally grooved wall means defining said rearward bore means;

external coupling means engaging said tubular member;

bored gripping means having a rearward collar portion dimensioned to closely receive said cable therethrough and having an outwardly directed annular flange at a rearward end, and said gripping means having a plurality of tapered spline fingers extending forward from the periphery of said collar portion defining therebetween a profiled opening of a dimension substantially equal to said cable diameter, and said gripping means being rearwardly disposed of said tubular member, whereby, upon moving said gripping means forwardly into said rearward bore means with said gripping means flange abutting a rearward end of said tubular member, said spline fingers are resiliently deflected inwardly along said contour to embed into an outer conductive layer of said cable, said grooved wall means engaging said gripping means collar portion to resist rotational movement of said gripping means within said tubular member.

4. An electrical connector plug for terminating an outer conductive sheath of a semirigid coaxial cable, comprising:

a gripping collar closely receiving said cable therethrough and having a plurality of spline fingers extending forwardly from the periphery of said collar;

a tubular shell member having a bore for receiving said cable therethrough, said bore comprising a rearward portion of relatively large diameter receiving insertion of said gripping collar therein with interference, and a contiguous forward portion of smaller inner diameter substantially equal to said cable outer diameter and receiving insertion of said collar spline fingers therein, said bore being defined by inner surfaces adapted to taper inwardly from said rearward bore portion to said forward bore portion, said surfaces engaging against and inwardly influencing said spline fingers into said cable upon said insertion of said collar into said shell member; and said inner surfaces defining said rearward bore portion having longitudinal grooves formed therein, said gripping collar engaging said grooves to resist rotational movement between said gripping collar and said shell member.

5. A connector plug as set forth in claim 4, said spline fingers each being tapered to a point.

6. An electrical connector plug for terminating an outer conductive sheath of a semirigid coaxial cable, comprising:

a tubular shell member having a bore for receiving said cable therethrough, said bore comprising a rearward portion of relatively large inner diameter and a contiguous forward portion of smaller inner diameter substantially equal to said cable outer diameter, said bore being defined by inner surfaces adapted to taper inwardly from said rearward bore portion to said forward bore portion;

a gripping collar closely receiving said cable therethrough and seated within rearward portion of said shell member bore, said gripping collar having a plurality of spline fingers extending forward from the periphery of said collar, said spline fingers engaging against and being inwardly influenced by said tapered inner surfaces to penetrate and embed into said outer sheath of said cable; and said inner surfaces defining said rearward bore portion having longitudinal grooves formed therein, said gripping collar engaging said grooves to resist rotational movement between said gripping collar and said shell member.

7. An electrical connector plug for terminating semirigid coaxial cable, comprising:

center contact means in electrical engagement with a center conductor of said cable;

a bored tubular shell member having rearward bore means of relatively large inner diameter inwardly contoured toward forward bore means having a relatively smaller inner diameter dimensioned to receive said cable and said contact means therethrough;

external coupling means engaging said tubular member;

bored gripping means having a rearward collar portion dimensioned to closely receive said cable therethrough, and having a plurality of spline fingers extending forward from the periphery of said collar portion defining therebetween a profiled opening of a dimension substantially equal to said cable diameter, and said gripping means being rearwardly disposed of said tubular member, whereby, upon moving said gripping means forwardly into said rearward bore means, said spline finger are resiliently deflected inwardly along said contour to embed into an outer conductive layer of said cable;

said gripping means having an outwardly-directed annular flange at a rearward end in abutting engagement against a rearward end of said tubular shell member.

8. An electrical connector for terminating a semirigid outer conductor of a coaxial cable, comprising:

tubular means having forward section means having a smaller diameter than a bore of said rear section means, and contour surface means connecting the bores of said forward and rear section means, said smaller diameter bore being dimensioned so as to be slightly larger than the coaxial cable to freely receive the coaxial cable therethrough;

conductor gripping means having collar means dimensioned so as to be slightly larger than the coaxial cable to receive the coaxial cable therethrough, engaging means at an outer end of said collar means and tapered finger means extending forwardly from an inner end of said collar means;

said conductor gripping means being forcibly movable along the coaxial cable into said tubular means with said tapered finger means being deflected inwardly into embedded electrical engagement with the semirigid outer conductor by engagement of said tapered finger means with and movement along said contour surface means and along said smaller diameter bore as said conductor gripping means is being forcibly moved into said rear and forward section means of said tubular means.

9. An electrical connector as set forth in claim 8 wherein the bore of said rear section means has longitudinal grooves which grip an outer surface of said collar means as said collar means moves into and along said rear section means until said engaging means engages said rear section means thereby resisting rotational movement between said conductor gripping means and said tubular means.

10. An electrical connector as set forth in claim 8 wherein annular flange means extend outwardly from an outer surface of said tubular means, coupling means having annular lip means freely movable on said tubular means between said annular flange means and a position on said tubular means.

11. An electrical connector as set forth in claim 8 wherein said tapered finger means have pointed ends.

12. An electrical connector as set forth in claim 8 wherein a center conductor of the coaxial cable has a section extending outwardly from insulation means surrounding the center conductor and defines a center contact member.

13. An electrical connector as set forth in claim 8 wherein center contact means is connected to a center conductor of the coaxial cable and disposed in dielectric means positioned in said forward section means of said tubular means.

14. An electrical connector as set forth in claim 8 wherein said engaging means comprises flange means.

15. An electrical connector for terminating coaxial electrical cable of the type having a tubular solid outer conductor, comprising a tubular conductive body member having two axially aligned portions of mutually different internal diameter, through both of which portions the cable can pass, and a ferrule locatable within the larger internal diameter portion of the body member with the cable passing therethrough, the ferrule having an outwardly-directly annular flange at one end, and a plurality of fingers extending from the periphery at the other end and parallel to the axis of the ferrule, characterized in that the ferrule has a tubular body portion between the flange and the fingers, the fingers being thinner than the body portion, the larger internal diameter portion of the body member being shaped such than on movement of the ferrule axially along the cable the tubular body portion of the ferrule enters the larger internal diameter portion of the body member and is compressed thereby into intimate engagement with the outer conductor of the cable, while the fingers on the ferrule enter the smaller internal diameter portion of the body member, which is cylindrical, and are compressed into intimate penetrating engagement with the outer conductor of the cable for substantially their entire length.

16. A connector as claimed in claim 15, characterized in that the free ends of the fingers of the ferrule are pointed.

17. A connector as claimed in claim 15 or 16, characterized in that the larger internal diameter portion of the body member is formed with a plurality of axially extending internal splines which bite into the tubular body portion of the ferrule into the larger diameter portion of the body member thereby to compress the body portion into intimate engagement with the outer conductor of the cable and also prevent relative rotary movement between the ferrule and the body member.

18. An electrical connector for terminating a semirigid outer conductor of a coaxial cable, comprising:

shell body means having bore means dimensioned so as to be slightly larger than the coaxial cable to freely receive the coaxial cable therethrough, annular projection means extending outwardly from an external surface of said shell body means;

coupling means having inwardly-directed annular lip means disposed along a section of said external surface of said shell body means rearwardly of said annular projection means and being freely movable and rotatable relative to said shell body means; and ferrule means having outwardly-directed annular flange means, said ferrule means being axially and frictionally movable along a rear section of said shell body means upon an axial force being applied to said annular flange means when the coaxial cable is disposed within said bore means thereby frictionally connecting said ferrule means with said rear section of said shell body means, electrically connecting said shell body means to the semirigid outer conductor and maintaining said annular lip means of said coupling means between said annular projection means and said annular flange means so that said coupling means is freely rotatable and axially movable relative to said shell body means.

19. An electrical connector as set forth in claim 18, wherein said ferrule means is to be positioned within said bore means of the shell body means into frictional and physical engagement with the semirigid outer conductor.

* * * * *

UNITED STATES PATENT OFFICE

CERTIFICATE OF CORRECTION

Patent No. 4452503 Dated June 5, 1984

Inventor(s) Edgar W. Forney, Jr.

It is certified that error appears in the above-identified patent and that said Letters Patent are hereby corrected as shown below:

Column 8, line 28, after "means" add ---and physically engaging said rear section---.

Signed and Sealed this

Ninth Day of October 1984

[SEAL]

*Attest:*

GERALD J. MOSSINGHOFF

*Attesting Officer*

*Commissioner of Patents and Trademarks*